United States Patent [19]

Deutsch et al.

[11] Patent Number: 4,823,667

[45] Date of Patent: Apr. 25, 1989

[54] GUITAR CONTROLLED ELECTRONIC MUSICAL INSTRUMENT

[75] Inventors: Ralph Deutsch, Sherman Oaks; Leslie J. Deutsch, Sepulveda, both of Calif.

[73] Assignee: Kawai Musical Instruments Mfg. Co., Ltd., Hamamatsu, Japan

[21] Appl. No.: 64,427

[22] Filed: Jun. 22, 1987

[51] Int. Cl.[4] ..... G10H 3/18; G10H 7/00

[52] U.S. Cl. ..... 84/1.16; 84/1.22; 84/DIG. 9

[58] Field of Search ..... 84/1.14, 1.15, 1.16, 84/1.19–1.23, 454, DIG. 9

[56] References Cited

U.S. PATENT DOCUMENTS 4,151,775 5/1979 Merriman ..... 84/1.16 X
4,627,323 12/1986 Gold ..... 84/1.16 X
4,688,464 8/1987 Gibson et al. ..... 84/454

*Primary Examiner*—Stanley J. Witkowski
*Attorney, Agent, or Firm*—Ralph Deutsch

[57] ABSTRACT

Apparatus is disclosed whereby an electronic musical tone generator is controlled in response to a musical instrument using mechanically vibrated strings. A bank of digital note filters is associated with each string to find the closest true musical note frequency corresponding to the vibration frequency of the string. The filters operate by computing the autocorrelation function of the string's vibration waveshape and then performing a Fourier transform to obtain the identification of the closest true musical note. An efficient and simple implementation is disclosed for an analog-to-digital signal conversion, the computation of the autocorrelation, and the Fourier transform. Provision is made for introducing frequency changes corresponding to a pitch bend in the vibration frequencies of the string.

8 Claims, 6 Drawing Sheets

GUITAR CONTROLLED ELECTRONIC MUSICAL INSTRUMENT

BACKGROUND OF THE INVENTION

1. Field of the Invention

The invention relates to the use of a guitar to control musical tones generated by an electronic musical instrument.

2. Description of the Prior Art

Most of the present generation of electronic musical instruments, such as those known by the generic name of tone "synthesizers" are operated and controlled from a clavier type keyboard. With the employment of a variety of available digital command interfaces for controlling a tone synthesizer, there is really no inherent restriction that the input note data information be provided by a keyboard.

Guitar controllers for interfacing with a tone synthesizer have been implemented by using frequency analyzers which are configured as frequency-to-voltage devices. These provide a control voltage which corresponds to the fundamental frequency of an analog signal produced by the acoustic transducers used to convert the guitar string vibrations to an electrical signal. There are inherent and conflicting limitations in a system employing frequency-to-voltage devices for a guitar controller. A plucked guitar string has a time variant waveshape which can be roughly divided into three time intervals. The first region corresponds to the onset of tone when a string is plucked. This region produces a signal which has a noise-like character. The second time region is a sort of transitional region wherein the noise-like character of the sound starts to diminish and the onset of a musical waveshape having pronounced higher harmonics begins. In the third time region the generated musical waveshape assumes a quasi-steady state in which the harmonics are essentially stable and the strings emit the characteristic guitar tone.

If a frequency-to-voltage conversion device follows the frequency variations of the waveshape with a very fast response time, "glitches" or totally unrecognizable and somewhat objectionable transient tones would be produced by the controlled tone synthesizer in response to the rapidly varying generated control signals. If the response time of the frequency-to-voltage device is slowed down sufficiently so that it does not respond to the first two regions of the plucked guitar string musical waveform then an audible delay will occur between the time the guitar string is plucked and the time at which the controlled tone synthesizer starts to generate as associated tone. This delay time can be both objectionable and distracting to both the guitar player and a listener. A frequency-to-voltage conversion device requires about two to ten cycles of a waveform to determine the pitch of the corresponding note. For a low frequency guitar note such as $E_2$ which has a frequency of 82.41 Hz, a delay of even two cycles corresponds to a time delay of about 24 milliseconds. This time delay is clearly obvious to the player and listener.

SUMMARY OF THE INVENTION

Apparatus is described by which the mechanical vibrations of a stringed musical instrument are used to control musical tones produced by a polyphonic electronic musical tone generator. A bank of tuned filters is implemented which serve to determine the closest true musical note corresponding to the fundamental frequency of a vibrating string. These filters operate by first computing the autocorrelation of a waveshape produced from a transducer in close proximity to the vibrating string. A Fourier transform is then used to transform the autocorrelation function to obtain the spectral content of the signal produced by the transducer. A random number generator and a comparator are used in combination to convert the analog signal produced by the transducer into a sequence of one-zero logic state signals. A shift register and an Exclusive-Nor gate was used in combination to generate the components of the transducer's output signal autocorrelation function. A bank of contiguous filters is implemented by using a combination of sinusoid tables storing preselected trigonometric function values, a 2's complement device, and an adder-accumulator for each filter element in the bank of contiguous filters.

A maximum select logic is used to identify the particular filter that has the maximum response to the fundamental frequency of the vibrating string. In this fashion the closest true musical frequency to the fundamental frequency of the vibrating string is determined.

The output data from the filters is encoded into a MIDI data format which in turn is used to control a musical tone generator implemented to respond to input data coded in the MIDI data format.

BRIEF DESCRIPTION OF THE DRAWINGS

The detailed description of the invention is made with reference to the accompanying drawings.

DETAILED DESCRIPTION OF THE INVENTION

The present invention is directed toward a system for controlling an electronic musical tone synthesizer in response to plucked guitar strings.

Figure 1:
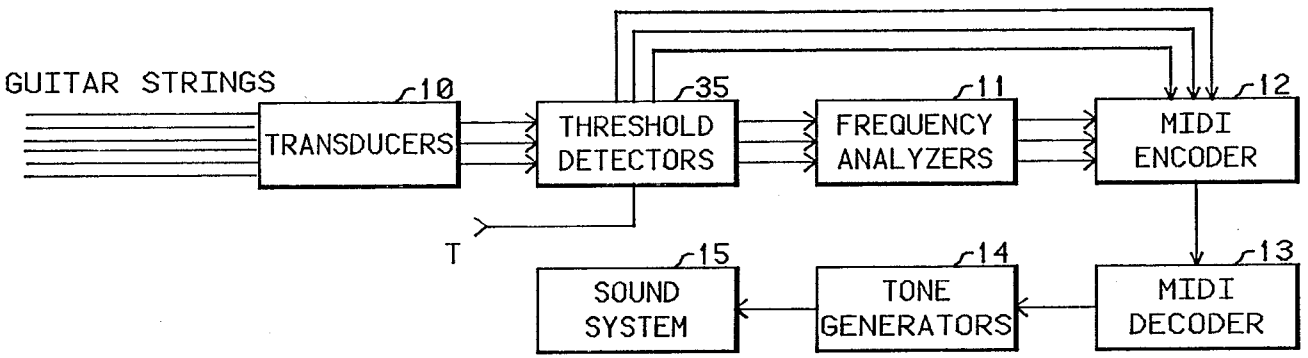
FIG. 1 is a schematic diagram of an embodiment of the invention.

FIG. 1 illustrates the basic system elements of a guitar controlled electronic musical instrument. One transducer in the set of transducers 10 is positioned in close proimity to each of the guitar strings so that the mechanical vibrations of the strings are converted into an electrical analog signals.

The string waveshape signal generated by the transducer 10 is furnished to the threshold detect 35. A function of the threshold detect 35 is to determine when a string's mechanical vibration state has been sufficiently damped so that a tone off signal can be generated and transmitted to the tone generator 14. The threshold detector generates a tone on signal when the output signal envelope from a string transducer has exceeded a predetermined threshold amplitude level. Both the tone on and tone off signals are provided as control input data signals to MIDI encoder 12.

Associated with each string is a transducer in the set of transducers 10, a threshold detector in the set of threshold detectors 35, a frequency analyzer in the set of frequency analyzers 11, and a tone generator in the set of tone generators 14. The system operation is described for a single guitar string and a single tone generator. The system operation for the remaining strings is the same as that presented for the illustrative string. While for convenience reference is made to the blocks shown in FIG. 1 which represents a system having a plurality of strings, it is to be understood in the following opertion description that a reference to a system block is to be interpreted as a reference to an element within that block which is associated with the illustrative string.

Figure 2:
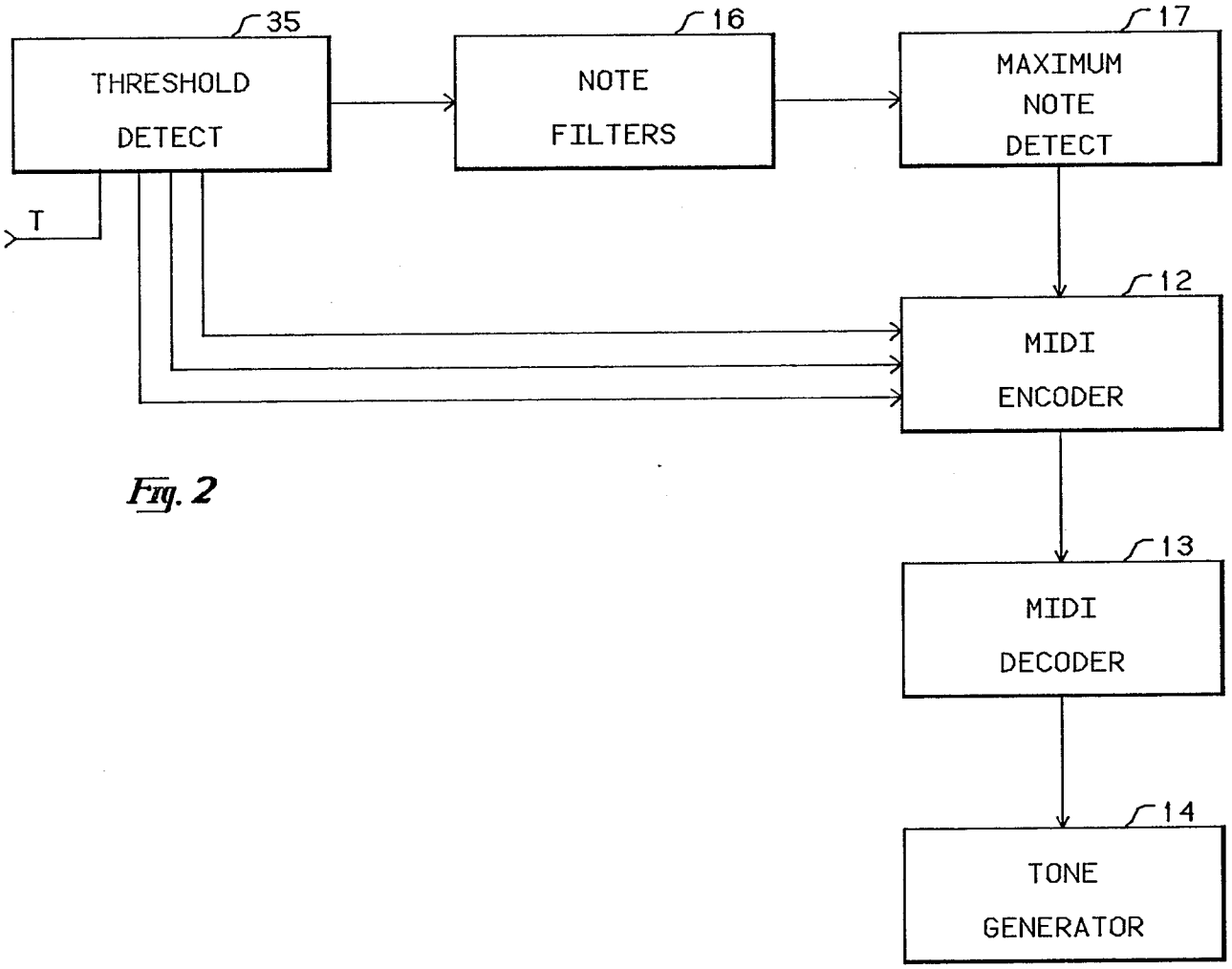
FIG. 2 is a block diagram of the frequency analyzers 11.

The string waveshape signal provided by the transducer 10 is transmitted by the threshold detect 35 to the frequency analyzers 11. FIG. 2 illustrates the elements of the frequency analyzers 11 which comprise the note filter 16 and the maximum note detect 17.

The inventive system employs a spectral analysis of the string waveshape signal produced by the transducer 10 to identify the fundamental frequency of a plucked guitar string. The string waveshape signal output from the threshold detector 35 is transferred to the note filter 16. The note filter 18 consists of a bank, or array, or eighteen contiguous pass band filters. Each of these filters corresponds to one of the eighteen fret positions for a guitar string. There is a separate bank of filters associated with each one of the six guitar strings.

The maximum note detect 17 determines which one of a bank of filters has the maximum output and thereby identifies the closest musical note that corresponds to a fretted plucked guitar string. The identified musical note is encoded onto a standard MIDI note signal by means of the MIDI encoder 12. The tone on signal generated by the threshold detect 35 is also encoded onto the MIDI note signal by means of the MIDI encoder 12.

Figure 3:
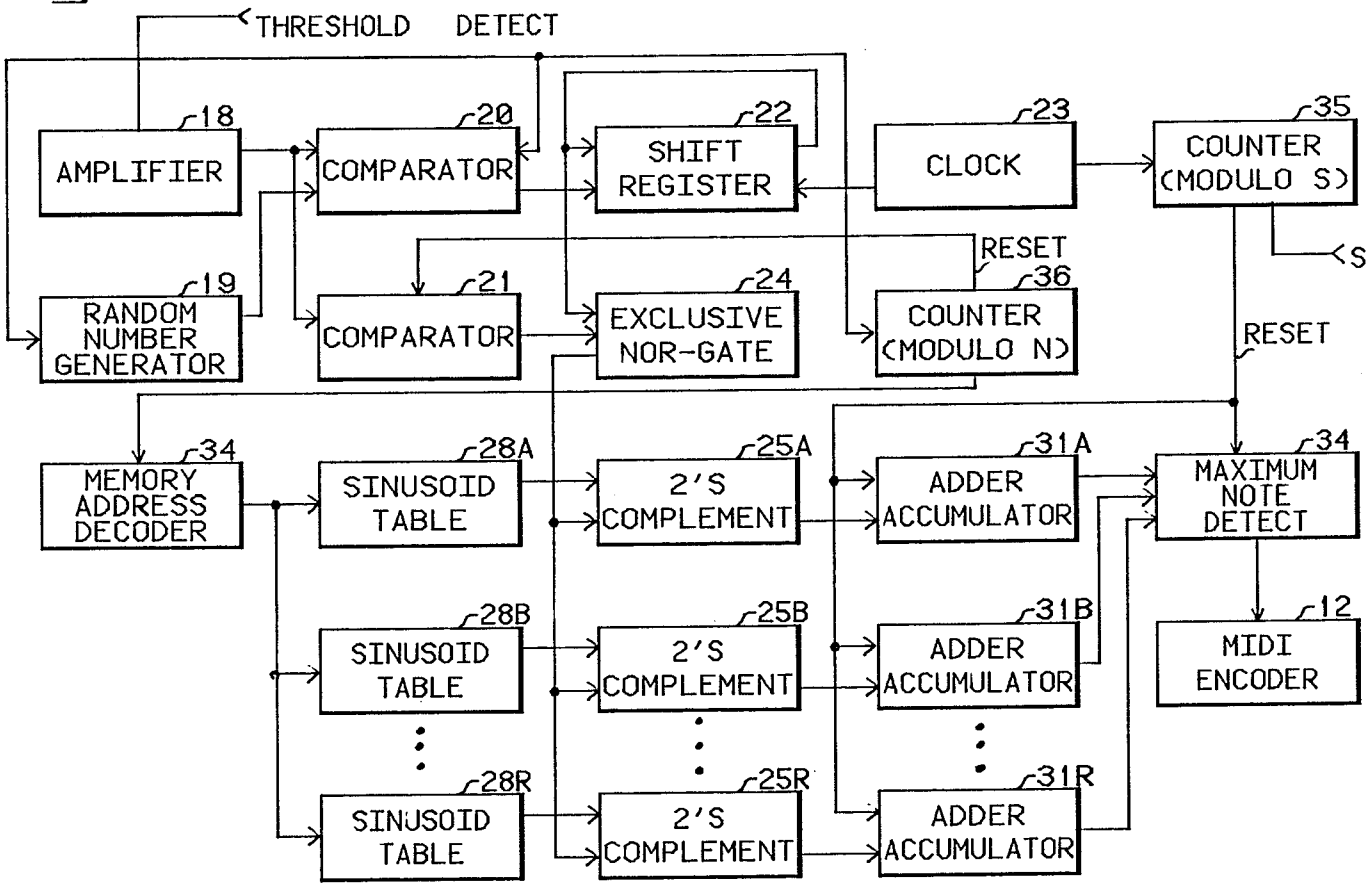
FIG. 3 is a schematic diagram of a note filter.

FIG. 3 illustrates the detailed logic of one of the note filters contained in the note filters 16. There is a similar note filter associated with each of the transducers corresponding to each of the guitar strings. Each note filter functions by first computing the autocorrelation function of the string waveshape signal furnished by its associated transducer and transferred by the threshold detect 35. The transferred signal is amplified in magnitude by means of the amplifier 18. The computed autocorrelation is then converted to a power spectral density function by means of a subsystem which implements a discrete Fourier transform algorithm.

The random number generator 19 generates pairs of random numbers $y_i$ and $y_j$ which are each statistically independent and are uniformly distributed in value and have a maximum value equal to a number B and a minimum amplitude equal to $-B$. There are many implementations for suitable random number generators. One such implementation is disclosed in U.S. Pat. No. 4,327,419 entitled "Digital Noise Generator For Electronic Musical Instruments." This patent is hereby incorporated by reference.

The clock 23 is designed to generated s sequence of timing signals having a frequency which is about 2.1 times the maximum fundamental frequency of the shortest fretted guitar string whose transduced electrical signal is connected to the amplifier 18. For the guitar string tuned to the musical note $E_2$ having a fundamental frequency of 329.63 Hz, the eighteenth fretted string corresponds to the musical note $A_5$ having a fundamental frequency of 880 Hz. Therefore the clock 23 is designed to generate timing signals at a frequency of $f_s=2.1\times880\times F=1848F$. F is the number of frets for the guitar strings. For F=18, $f_s=33.264$ KHz.

The comparator 20 generates a logic "1" state binary signal if the signal $x_i$ furnished by the amplifier 18 at a time $t_i$, corresponding to a timing signal furnished by the clock 23, is greater than or equal in numeric magnitude to the random number $y_i$ generated by the random number generator 19 at the same time $t_i$. If the data value $x_i$ is less in numeric amplitude than the random number $y_i$, then a logic "0" state binary signal is generated by the comparator 20. The sequence of binary state signals generated by the comparator 20 are stored in the shift register 22. The shift register 22 can store N data points and is operated in a conventional end-around mode in response to the timing signal furnished by the clock 23. That is, the shift register 22 operates by taking an output data point and reinserting it in the input position of the serial sequence storage of the N data words generated by the comparator 20.

The action of the comparator 20 is to convert the analog signal from the amplifier 18 to a digital signal and to compute the value of $\mathrm{sgn}(z_i)$ for the difference of the signals $x_i-y_i$. sgn denotes the mathmetical signum function and the subscript i denotes a quantity occurring at a time $t_i$ corresponding to one of the timing signals produced by the clock 23. For each data value generated by the comparator 20, the shift register is shifted N times after the new value has been placed in the initial, or input, position of the shift register 22 thereby replacing the oldest previously stored data value in the shift register 22.

In the same fashion as described for the comparator 20, the comparator 21 will generate a "1" binary state signal if the signal amplitude $z_j$ from the amplifier 18 is greater than or equal to the second random number generator 19. The comparator 21 will generate a logic "0" binary state signal if the signal amplitude $x_j$ is less than the random signal $y_j$. The action of the comparator 21 is to convert an analog signal from the amplifier 18 into a digital signal and to compute the value of the quantity $\mathrm{sgn}\ z_j=\mathrm{sgn}(x_j-y_j)$.

The autocorrelation function R(q) for the sequence of signal values $x_i$;i=1, 2, . . . is defined by the relation $$R_x(q)=E\{x_ix_{i-q}\} \qquad \text{Eq. 1}$$

where q is the time lapse between a pair of data points $x_i$ and $x_{i-q}$ measured in the number of data points q. E{ } denotes the expected value, or the statistical weighted average, of the quantity within the braces. Eq. 1 can be written in the following equivalent form $$R(q) = [1/(1/N-q)]\sum_{i=1}^{N-q} x_ix_{i-q} \qquad \text{Eq. 2}$$

where N denotes the number of pairs of data values used to form the average value.

For the system shown in FIG. 3, the autocorrelation function in the form of Eq. 2 can be written as $$R_x(q) = [B^2/(N-q)]\sum_{i=1}^{N-q} \mathrm{sgn}\ z_i\ \mathrm{sgn}\ z_{i-q} \qquad \text{Eq. 3}$$

The product of the signum functions in Eq. 3 obey the following truth table.

TABLE 1

| sgn $z_i$ | sgn $z_{i-q}$ | sgn $z_i$ * sgn $z_{i-q}$ |
|---|---|---|
| 1 | 1 | 1 |
| 0 | 0 | 1 |
| 1 | 0 | 0 |
| 0 | 1 | 0 |

The logic truth table listed in Table 1 is the same as the truth table for an Exclusive-Nor gate.

The comparator 21 generates a signum value each time that the counter 36 is reset to its initial count state at which time a RESET signal is generated. The counter 36 is incremented by the timing signals produced by the clock 23 and the counter is implemented to count modulo N.

The Exclusive-Nor gate 24, according to the logic listed in Table 1, forms the product of the previous N signum values generated by the comparator 20 with the current signum value generated by the comparator 21.

The power spectral density function G(f) is defined as the Fourier transform of the autocorrelation function R(q). Thus G(f) can be written in the form $$G(f) = 2T_s\left[R_x(0) + 2\sum_{q=1}^{m-1} R(q)\cos(\pi qf/f_s) + R(m)\cos(\pi mf/f_s)\right]. \quad \text{Eq. 4}$$

where $$m=2f_s/D \quad \text{Eq. 5}$$

and $$T_s=1/f_s \quad \text{Eq. 6}$$

D is the resolution bandwidth of one of the group of contiguous filters assigned to determine the fundamental frequency of the tone produced by a corresponding guitar string.

In the system shown in FIG. 3, since the power spectral density function G(f) is only computed at discrete frequencies $f=kf_s/m$, Eq. 4 can be written in the following discrete form $$G_k = G(kf_s/m) = 2T_s\left[R(0) + 2\sum_{q=1}^{m-1} R(q)\cos(\pi qk/m) + (-1)^k R(m)\right] \quad \text{Eq. 7}$$

If Eq. 3 and Eq. 7 are combined the result is $$G_k = 2T_sB^2/(N-q)\left[\sum_{i=1}^{N-q} h_i(0) + (-1)^k\sum_{i=1}^{N-q} h_i(m) + 2\sum_{q=1}^{m-1}\sum_{i=1}^{N-q} h_i(q)\cos(\pi qk/m)\right] \quad \text{Eq. 8}$$

where $$h_i(q)=sgn\ z_i\ sgn\ z_{i-q} \quad \text{Eq. 9}$$

The first two terms on the right hand side of Eq. 8 are independent of frequency and thus their contribution can be neglected in a frequency determination calculation. It is noted in the last summation in Eq. 8 that $h_i(q)$ either has the value "1" or the value "0". The "0" value can be considered as a negative algebraic sign in the definition of the signum function. Therefore the indicated multiplication in this last summation can be simply implemented as a 2's complement binary operation on a binary data format for the trigonometric cosine function. No 2's complement is performed if $h_i(q)=1$ and the 2's complement is performed if $h_i(q)=0$.

Because of the logarithmic spacing of the center frequencies for the fundamental frequencies for successive musical tones in an equal tempered musical scale, the value of k in Eq. 8 is replaced by the parameter $$k'=2^{(k-1)/12} \quad \text{Eq. 12}$$

The sinusoid table 28A stores the values $\cos(\pi/12), \cos(\pi 2/12), \cos(\pi 3/12), \ldots, \cos(\pi 12/12)$ The sinusoid table 28B stores the values $\cos(\pi p_1/12), \cos(\pi 2p_1/12), \cos(\pi 3p_1/12), \ldots, \cos(\pi 12p_1/12)$ wherein $p_1=2^{1/12}=1.05946$.

In general the j"th sinusoid table 28j stores the values $\cos(\pi p_j/12)\ \cos(\pi 2p_j/12), \cos(\pi 3p_j/12), \ldots, \cos(\pi 12p_j/12)$ where $p_j=2^{j/12}$.

The trigonometric sinusoid function values stored in the set of sinusoid tables 28A–28R are addressed simultaneously in response to the count state of the counter 36 by means of the memory address decoder 34.

There is a 2's complement means 25A–25R associated with each one of the sinusoid tables 28A–28R. Each of the 2's complement means will transfer its input trigonometric function furnished by its associated sinusoid table unaltered if the current output from the exclusive OR-gate 24 has a "1" logic binary signal state. If the output signal from the Exclusive-Nor gate 24 has a "0" logic binary signal state, each one of the 2's complement means 25A–25R will perform a 2's complement operation on its associated input trigonometric function value before transferring an output data value.

There is an adder-accumulator in the set 31A–31R associated with each of the 18 2's complement means. Each adder-accumulator adds the data value provided by its associated 2's complement to the sum contained in an accumulator which is an element of each of the adder-accumulators 31A–31R.

The data value contained in each of the accumulators in the set of adder-accumulators 31A–31R is transferred to the maximum note detect 34. In a manner described below, the maximum note detect 34 determines which one of the set of 18 adder-accumulators 31A–31R contains the maximum data value at the time at which the counter 35 generates a RESET signal.

The counter 35 counts the timing signals provided by the clock 23 modulo a prespecified number S. Each time that the counter 35 is incremented so that it returns to its minimal count state, a RESET signal is generated. The modulo number S is provided to the counter 35 by any one of a variety of convenient means such as a multiposition binary data switch or a digital data generating keyboard terminal. The value of S determines the integration time, or the response time of the bank of contiguous filters associated with a given guitar string.

The RESET signal generated by the counter 35 is used to initialize to a zero value all the accumulators in the set of adder-accumulators 31A–31R.

Figure 4:
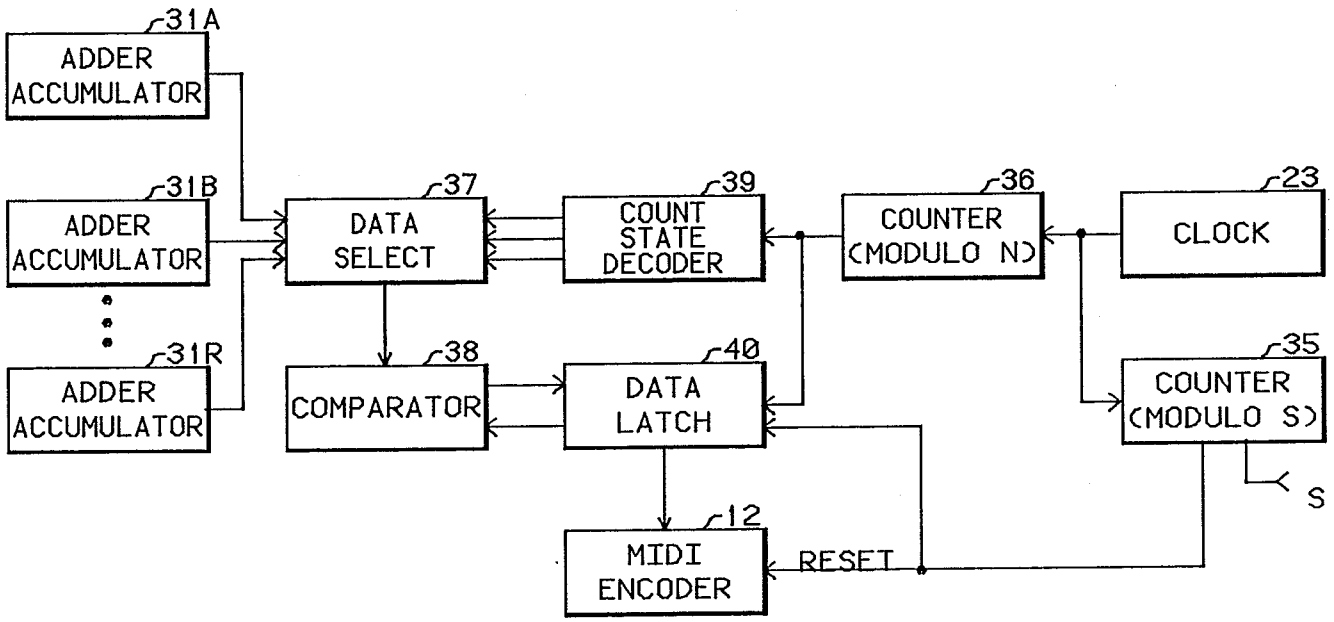
FIG. 4 is a schematic diagram of the maximum note detect 34.

FIG. 4 illustrates the detailed system logic for the maximum note detect 34. The set of adder-accumulators 31A–31R are connected such that the data value stored in each of their accumulators is provided to the data select 37. The counter 36 counts the timing signals produced by the clock 23 modulo the number F=18. The binary count states of the counter 36 are decoded onto a set of 18 signals lines by means of the count state decoder 39. In response to signal on one of the 18 lines from the count state decoder 39, the data select 37 transfers the content of an associated accumulator in the set of adder-accumulators 31A–31R to the comparator 38.

The comparator 38 compares the numerical value of the data transferred by the data select 37 with a data word value stored in the data latch 40. If the data value received by the comparator 38 from the data latch 40 is greater in numerical value than the numerical value of the data word stored in the data latch 40, then the comparator 38 causes the larger of the two data values to be stored in the data latch 40. If the data value stored in the data latch 40 is changed from its prior value, then the comparator 38 causes the data latch 40 to also store the current count state of the counter 36.

When the RESET signal is generated by the counter 35, the count state data word stored in the data latch 40 is transferred to the MIDI encoder 12 and then the contents of the data latch 40 is reset to zero values. This transferred value identifies the fundamental frequency of the plucked guitar string associated with this bank of contiguous filters.

The MIDI encoder 12 encodes the note identification information data received from the data latch 40 and the threshold detect 35 into a data format which can be recognized by the tone generator 14 which has MIDI interface circuitry.

MIDI is an acronym for Musical Instrument Digital Interface. MIDI is a specification in present use for a wide variety of digitally controlled muxic devices. The details of MIDI specification are available from the International MIDI Association, 11857 Hartsook St., North Hollywood, Calif. 91607. A description and discussion of the MIDI specification is contained in the technical article:

Gareth Lag, "Musicians Make A Standard: The MIDI Phenomenon." Computer Music Journal, Vol. 9, No. 4, Winter 1985.

The MIDI decoder 13 can be implemented by circuitry which functions in accordance with the MIDI specification. One such implementation is the commercial product MPU-401 manufactured by the Roland Corp. U.S., 7200 Dominian Circle, Los Angles, Calif. 90040. The MPU-401 can be installed as an auxiliary board in an IBM personal computer so that signals received by the computer from its data bus can be encoded into MIDI signals using a computer program such as that the BASIC source program code shown in Table 2.

TABLE 2

```
10 REM * PROGRAM TO CONVERT NOTE NUMBERS TO
MIDI FORMAT DATA FOR MPU401
20 DIM BYTE(3)
30 REM  INQUIRE AS TO THE NOTE NUMBER (0 IS C2)
40 I=INP(810)
50 IF I AND 1 = 0 THEN 40
60 NOTE=INP(811)
```

TABLE 2-continued

```
70 INPUT NOTE
80 REM  INQUIRE IF THE NOTE IS TO BE
ASSIGNED OR UN-ASSIGNED
90 I=INP(812)
100 IF I AND 1 = 0 THEN 90
110 ONOROFF=INP(813)
120 REM  CHECK TO SEE OF THE MPU401 IS
READY TO ACCEPT DATA
130 I = INP(817)
140 IF I AND 32 = 0 THEN 130
150 REM  MPU IS NOW READY TO RECIEVE NEW
DATA. WE NOW
160 REM  SEND THE COMMAND THAT TELLS THE
MPU401 THAT WE WANT
170 REM  TO SEND IT SOME DATA
180 OUT 817,208
190 REM  CHECK TO MAKE SURE THAT THE MPU401
HAS ACKNOWLEDGED
200 REM  THE COMMAND THAT WE JUST SENT
210 I = INP(817)
220 IF I AND 64 = 0 THEN 210
230 I = INP(816)
240 IF I <> 254 THEN 230
250 REM  MPU401 HAS ACKNOWLEDGED OUR
COMMAND. NOW WE ASSEMBLE THE
260 REM  BYTE STREAM FOR THE NOTE DATA
ACCORDING TO MIDI STANDARDS
270 BYTE(1)=144
280 BYTE(2)=NOTE
290 IF ONOROFF = 1 THEN BYTE(3) =
50 ELSE BYTE(3) = 0
300 REM  SEND THE THREE-BYTE MIDI STEAM
TO THE MPU401
310 FOR J = 1 TO 3
320 REM  CHECK TO SEE IF MPU401 IS
READY FOR NEXT BYTE
330 I = INP(817)
340 IF I AND 32 = 0 THEN 320
350 REM  SEND THE NEXT BYTE TO THE MPU401
360 OUT 816,BYTE(J)
370 REM  LOOP BACK TO SEND THE NEXT BYTE
380 NEXT J
390 REM  GO BACK TO GET NEXT NOTE
DATA FROM THE USER
400 GOTO 40
410 END
```

The tone generator 14 can be any of the number of commercially available tone generators that are equipped to receive MIDI encoded data and translate such data into musical sounds. A suitable tone generator is the model K3 system available from Kawai America Corp., 24200 S. Vermont Ave., Harbor City, Calif. 90710-0438. This is a six note polyphonic musical tone generator so that a tone generator can be assigned to each of the guitar's strings. The MIDI decoder 13 consists of circuitry which is contained in a tone generator such as the K3.

Figure 5:
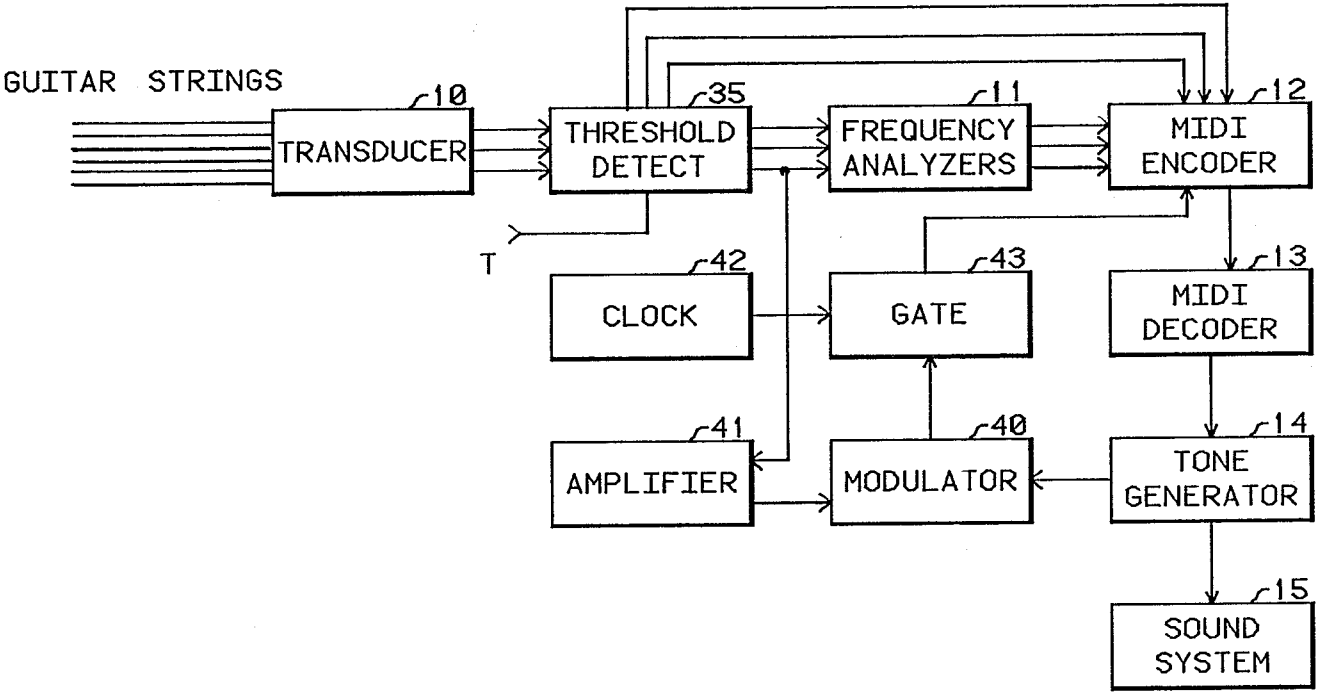
FIG. 5 is a schematic diagram of an alternate embodiment of the invention.

An alternative embodiment of the invention is shown in FIG. 5. A feature of the alternative embodiment is a means for having the fundamental frequency of the tone produced by the tone generator 14 to track variations in the frequency of the plucked guitar string such as those produced by the technique known as pitch bend. Pitch bend frequency changes are introduced during the playing of a note. The pitch bend frequency change information is computed by means of the modulator 40. The frequency change information produced by the modulator 40 is transferred to the MIDI encoder 12 which encodes the pitch bend data command in a standard MIDI data format which is assigned to pitch bend data.

Figure 6:
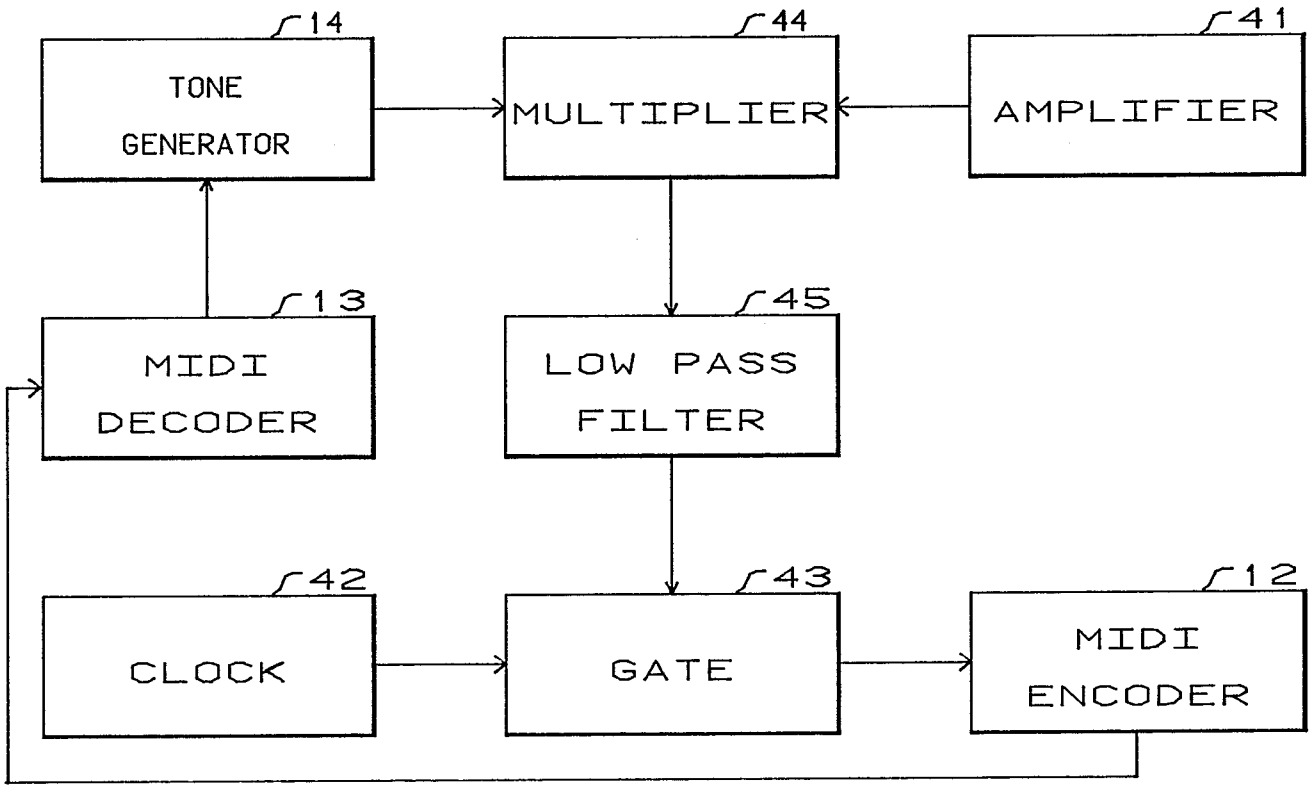
FIG. 6 is a schematic diagram of the pitch bend decoder 40.

The details of the modulator 40 are shown in FIG. 6. The modulator 40 comprises the system blocks 44 and 45. In response to the note MIDI data signal furnished by the MIDI encoder 12, the MIDI decoder 13 cause the tone generator 14 to create two waveshapes which have the same fundamental frequency. The first generated waveshape corresponds to the desired musical tone and it is furnished to the sound system 15. The second waveshape is a simple sinusoid waveshape which is furnished to the multiplier 44. The multiplier 44 multiplies the sinusoid waveshape produced by the tone generator 14 with the waveshape furnished by the amplifier 41.

The signal output produced by the multiplier 44 is a modulated signal having frequency components at the sum and difference of the tone generator's fundamental frequency and the instantaneous frequency of the guitar string. The upper side-band frequency components are eliminated by means of the low pass filter 45.

The signal having frequency components at the low frequency difference signal produced by the multiplier 44 is gated by means of the gate 43 in response to the timing signals generated by the clock 42. The output gated signal from the gate 43 is encoded by the MIDI encoder into the standard MIDI data format for a pitch bend signal and constitutes a pitch deviation word. The encoded signal causes the fundamental frequency of the tone generator 14 to track the instantaneous frequency changes of the plucked guitar string.

It is not necessary to have the tone generator 14 generate two distinct waveforms. The sinusoid waveform furnished to the multiplier 44 can be readily obtained by passing the musical waveform produced by the tone generator 14 through a low pass filter which is adjusted to strongly attenuate all the harmonics except for the fundamental frequency.

While the invention has been illustrated for a fretted string instrument such as a guitar, a fretted instrument is not a limitation of the invention. Unfretted string instruments such as the violin family, can also be used for the input control signals. The inventive system will cause the tone generators to track the closest musical note to that corresponding to the mechanical vibration of the strings.

We claim:

1. In combination with a musical instrument having a plurality of strings which produce musical tones when any of said strings are placed in a mechanical vibration state, apparatus for controlling a plurality of musical tone generators comprising;

a plurality of frequency controlling devices each of which is associated with a corresponding one of said plurality of strings wherein each one of said plurality of frequency controlling devices comprises;

a vibration transducer whereby in response to the mechanical vibration state of said associated strings a string waveshape signal having an envelope is generated, a threshold detect unit whereby an on-signal is generated if said envelope of said string waveshape signal is greater than or equal to a prespecified threshold signal amplitude and whereby an off-signal is generated if said on-signal has been generated and said envelope of said string waveshape signal is less than said prespecified threshold signal amplitude, a frequency analyzer means whereby a note data word is generated which identifies the closest musical note corresponding to said string wavehsape signal, a note encoding means whereby said note data word is encoded into a digital interface format data word in response to said on-signal and whereby a zero note data word is encoded into said digital interface data word in response to said off-signal, a tone generator whereby a prespecified musical waveshape is generated in response to said digital interface format data word, and a conversion means whereby said musical waveshape is transformed to an audible musical sound.

2. In combination with a musical instrument having a plurality of strings which produce musical tones when any of said strings are placed in a mechanical vibration state, apparatus for controlling a plurality of musical tone generators comprising;

a plurality of frequency controlling devices each of which is associated with a corresponding one of said plurality of strings wherein each one of said plurality of frequency controlling devices comprises;

a vibration transducer whereby in response to the mechanical vibration state of said associated string, a string waveshape signal having an envelope is generated, a threshold detect unit whereby an on-signal is generated if said envelope of said string waveshape signal is greater than or equal to a prespecified threshold signal amplitude and whereby an off-signal is generated if said on-signal has been generated and said envelope of said string waveshape signal is less than said prespecified threshold signal amplitude, a digital conversion means whereby said string waveshape signal is converted into a sequence of binary logic state signals, a plurality of contiguous note fillers each of which spans a musical note in the range of musical notes capable of being generated by said associated string and wherein each one of said plurality of contiguous note filters generates a note filter number in response to said sequence of binary logic state signals, and a maximum note detect means wherein a note data word is created in response to the maximum value of the note filter numbers generated by said plurality of contiguous note, a note encoding means whereby said note data word is encoded into a digital interface format data word in response to said on-signal and whereby a zero note data word is encoded into said digital interface data word in response to said off-signal, a tone generator whereby a prespecified musical waveshape is generated in response to said digital interface format data word, and a conversion means whereby said musical waveshape is transformed to an audible musical sound.

3. Apparatus according to claim 2 wherein said digital conversion means comprises;

a means for producing timing signals at a frequency corresponding with the highest musical note capability of said associated string, a random number generator wherein a first random number and a second random number is generated in response to said timing signals, and a first comparator means responsive to said string waveshape signal whereby a "one" binary logic state signal is generated if said first random number is greater than or equal in amplitude to said string wavehsape signal and whereby a "zero" binary logic state signal is generated if said first random number is less in amplitude than said string waveshape signal thereby generating said sequence of binary logic state signals.

4. Apparatus according to claim 3 wherein said plurality of contiguous note filters comprises;

a shift register means for storing a subsequence of a prespecified number M of logic states from said sequence of binary logic signals, a first counter means for counting said timing signals modulo said prespecified number M wherein a reset signal is generated each time said first counter returns to its minimal count state, a second comparator means responsive to said string waveshape signal whereby in response to said reset signal a "one" binary logic state signal is generated if said random number is greater than or equal in magnitude to said string waveshape signal and whereby a "zero" binary logic state signal is generated if said second random number is less in magnitude than said string waveshape signal, a shift register reading means whereby said binary logic state signals stored in said shift register means are sequentially read out in response to said timing signals, a Exclusive-Nor gate means responsive to said binary logic state signal generated by said second comparator means whereby a sequence of binary logic state control signals is generated in response to said binary logic state signals read out from said shift register means, a plurality of arithmetic means each of which generates a note filter number in response to said sequence of binary logic state control signals, and a second counter means for counting said timing signals modulo a prespecified number whereby a reset control signal is generated each time said second counter returns to its minimal count state.

5. Apparatus according to claim 4 wherein each one of said plurality of arithmetic means comprises;

a sinusoid table for storing trigonometric function values, a sinusoid table reading means whereby a trigonometric function value is read out from said sinusoid table in response to the count state of said first counter, a 2's complement means responsive to said sequence of binary logic state signals whereby a trigonometric function value read out of said sinusoid table is transferred unaltered in response to a binary logic state signal which has a "one" state value and whereby a trigonometric function value is converted into its binary 2's complement form in response to a binary logic state signal which has a "zero" state value before it is transferred, an adder-accumulator means, comprising an accumulator, whereby the trigonometric function values transferred by said 2's complement means are successively added to the content of said accumulator thereby generating said note filter number, and clearing circuitry whereby the content of the accumulator in said adder-accumulator means is initialized to a zero numeric state in response to said reset control signal.

6. In combination with a musical instrument having a plurality of strings which produce musical tones when any of said strings are placed in a mechanical vibration state, apparatus for controlling a plurality of musical tone generators comprising;

a plurality of frequency controlling devices each of which is associated with a corresponding one of said plurality of strings wherein each one of said plurality of frequency controlling devices comprises;

a vibration transducer whereby in response to the mechanical vibration state of said associated string, a string wavehsape signal having an envelope is generated, a threshold detect unit whereby an on-signal is generated if said envelope of said string waveshape signal is greater than or equal to a prespecified threshold signal amplitude and whereby an off-signal is generated if said on-signal has been generated and said envelope of said string waveshape signal is less than said prespecified threshold signal amplitude, a frequency analyzer means whereby a note data word is generated which identifies the closest musical note corresponding to said string waveshape signal, a pitch deviation detection means whereby a pitch deviation word is generated in response to a prespecified first musical waveshape and in response to said string waveshape signal, a note encoding means whereby said note data word is encoded into a first digital interface data word and said pitch deviation word is encoded into a second interface data word in response to said on-signal and whereby a zero note data word is encoded into said first digital interface data word and a zero pitch deviation word in encoded into said second interface data word in response to said off-signal, a waveshape generating means whereby, said prespecified first musical waveshape and said prespecified second musical waveshape are generated in response to said first digital interface data word and in response to said second digital interface data word, a conversion means whereby said prespecified first musical waveshape is transformed to an audible musical sound.

7. In combination with a musical instrument having a plurality of strings which produce musical tones when any of said strings are placed in a mechanical vibration state, apparatus for controlling a plurality of musical tone generators comprising;

a plurality of frequency controlling devices each of which is associated with a corresponding one of said plurality of strings wherein each one of said plurality of frequency controlling devices comprises;

a vibration transducer whereby in response to the mechanical vibration state of said associated string, a string waveshape signal having an envelope is generated, a threshold detect unit whereby an on-signal is generated if said envelope of said waveshape signal is greater than or equal to a prespecified threshold signal amplitude and whereby an off-signal is generated if said on-signal has been generated and said envelope of said string waveshape signal is less than said prespecified threshold signal amplitude, a frequency analyzer means whereby a note data word is generated which identifies the closest musical note corresponding to said string waveshape signal, a modulation means whereby said string waveshape signal is modulated by a prespecified first musical waveshape to produce a modulated signal having upper and lower frequency side bands, pitch signal generating means whereby the lower side band of said modulated signal is used to produce a pitch deviation signal, pitch encoding means whereby said pitch deviation word is generated in response to said pitch deviation signal, a note encoding means whereby said note data word is encoded into a first digital interface data word and a pitch deviation word is encoded into a second interface data word in response to said on-signal and whereby a zero note data word is encoded into said first digital interface data word and a zero pitch deviation word is encoded into said second interface data word in response to said off-signal, a waveshape generating means whereby a prespecified second musical waveshape and said prespecified first musical waveshape are generated in response to said first digital interface data word and in response to said second digital interface data word, and a conversion means whereby said prespecified second musical waveshape is transformed to an audible musical sound.

8. Apparatus according to claim 7 wherein said waveshape generating means comprises;

a low pass filter means whereby said first prespecified second musical waveshape is generated in response to said second prespecified musical waveshape.

* * * * *